US007954243B2

(12) United States Patent
De Wit et al.

(10) Patent No.: US 7,954,243 B2
(45) Date of Patent: Jun. 7, 2011

(54) HAIR CUTTING APPARATUS

(75) Inventors: Bastiaan Johannes De Wit, Drachten (NL); Fokke Roelof Voorhorst, Drachten (NL); Geert Veenstra, Drachten (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 197 days.

(21) Appl. No.: 11/630,393

(22) PCT Filed: Jun. 10, 2005

(86) PCT No.: PCT/IB2005/051919

§ 371 (c)(1),
(2), (4) Date: Dec. 19, 2006

(87) PCT Pub. No.: WO2006/000935

PCT Pub. Date: Jan. 5, 2006

(65) Prior Publication Data

US 2008/0016695 A1 Jan. 24, 2008

(30) Foreign Application Priority Data

Jun. 21, 2004 (EP) ..... 04102823

(51) Int. Cl.
*B26B 19/28* (2006.01)

(52) U.S. Cl. ..... 30/43; 30/43.91; 30/43.92; 30/44

(58) Field of Classification Search ..... 30/43, 43.7, 30/43.8, 43.9, 43.91, 43.92, 44
See application file for complete search history.

(56) References Cited

U.S. PATENT DOCUMENTS

| | | | | |
|---|---|---|---|---|
| 3,079,687 | A | 3/1963 | Jepson | |
| 3,266,143 | A | 8/1966 | Rangus | |
| 3,343,259 | A | 9/1967 | Brodie | |
| 5,207,731 | A * | 5/1993 | Bukoschek | 30/43.92 |
| 5,557,850 | A * | 9/1996 | Mun | 30/43.92 |
| 2002/0108251 | A1 * | 8/2002 | Brum et al. | 30/43.7 |
| 2004/0010922 | A1 | 1/2004 | Melton et al. | |
| 2008/0016690 | A1 * | 1/2008 | Veenstra et al. | 30/32 |
| 2008/0276459 | A1 * | 11/2008 | De Wit et al. | 30/43.6 |

FOREIGN PATENT DOCUMENTS

| | | | |
|---|---|---|---|
| EP | 0 487 537 | | 10/1993 |
| EP | 0 914 234 | | 5/1999 |
| WO | WO 2006000934 | A1 * | 1/2006 |
| WO | WO 2006000935 | A1 * | 1/2006 |

OTHER PUBLICATIONS

What Is Viscoelasticity?, http://www.wisegeek.com/what-is-viscoelasticity.htm.*

* cited by examiner

*Primary Examiner* — Jason Daniel Prone
(74) *Attorney, Agent, or Firm* — Sherry Womack

(57) ABSTRACT

Hair cutting apparatus having at least one cutting unit (2) with a stationary cutting member (3) and reciprocable movable cutting member (4) each having cooperating bearing surfaces (7,8) with cutting edges (9,10). To minimize the friction between the bearing surfaces a visco-elastic element is provided between the coupling element (14) and the movable cutting member (4) resulting in a small cutting gap between the bearing surfaces. During cutting of hairs the visco-elastic element behaves as a stiff element whereas during periods in which no hairs are cut the element behaves relatively soft so that the cutting gaps between the cutting edges are closed.

12 Claims, 2 Drawing Sheets

HAIR CUTTING APPARATUS

Figure 1:
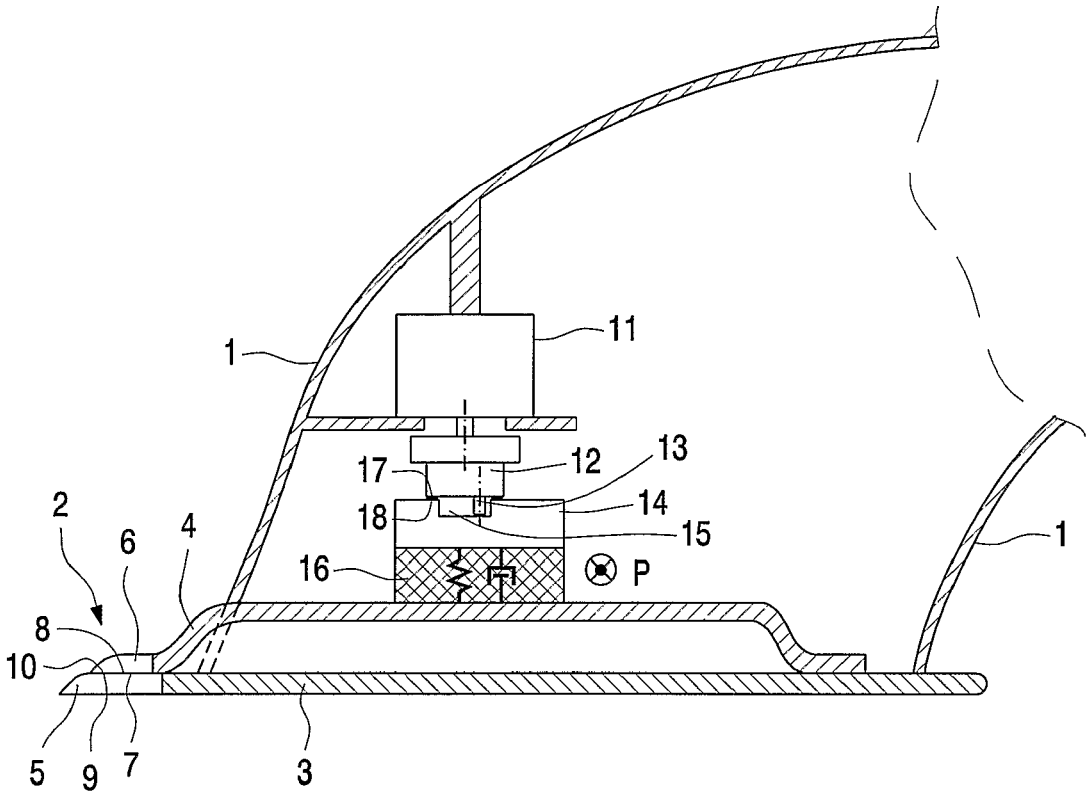

The invention relates to a hair cutting apparatus with a housing and at least one cutting unit which comprises a stationary cutting member and a driven cutting member performing a reciprocating movement with respect to the stationary cutting member, which driven cutting member is provided with cutting elements, each cutting element of the driven cutting member and the stationary cutting member being provided with mutually cooperating bearing surfaces having cutting edges and counter-cutting edges, respectively, for cutting hairs, said driven cutting member being provided with a coupling element, while said hair cutting apparatus further comprises a drive member for driving the driven cutting member via the coupling element.

Such a hair cutting apparatus is known, for example, from EP 0914234 or EP 0487537. If hairs are to be cut off satisfactorily, a so-termed cutting gap that is as small as possible must be present between the cooperating cutting edges of the driven and the stationary cutting member. This has been realized in practice until now in that the driven cutting member is made resilient towards the stationary cutting member. This causes the driven cutting member to bear on the stationary cutting member under a certain bias tension, i.e. the cutting edges of the driven cutting member are urged against the cutting edges of the stationary cutting member with a certain force. The cutting gap, therefore, is in fact zero. Said bias tension is necessary because the driven cutting member is decelerated during cutting of a hair, and the occurring cutting edges have a direction such that the cooperating cutting edges tend to be pressed apart somewhat, which could lead to too wide a cutting gap. The resilient force of the drive member prevents the gap between the cutting edges from becoming too great during cutting. As a result, the contact pressure between the driven and the stationary cutting member is small during cutting, and the friction is correspondingly small. The cooperating cutting edges in fact form the bearing surfaces of an axial bearing between the stationary and the driven cutting member. In those periods in which no hairs are cut, however, the bias tension causes a comparatively great contact pressure between the cooperating cutting members, and accordingly a comparatively strong friction. Less than 10% of the total cutting time is occupied by cutting of hairs during a normal cutting operation. The cutting edges bear on one another under spring pressure in the remaining time. This causes a friction during a major portion of the time which causes not only wear of the cutting edges, but which most of all requires a lot of energy. This means for rechargeable hair cutting apparatuses that their batteries have to be charged more often. Rechargeable batteries also have a finite life span, and after a certain time the batteries can no longer be sufficiently charged and will have to be replaced. A smaller friction between the cutting members makes the apparatus more energy-efficient.

It is an object of the invention to have the cutting process proceed satisfactorily in a hair cutting apparatus and to reduce the friction losses between the driven and the stationary cutting member still further.

The invention is for this purpose characterized in that means with visco-elastic properties are present between the coupling element and the driven cutting member.

The means with visco-elastic properties have resilient as well as damping properties, i.e. the means behave rigidly in the short term and slackly in the longer term. This means that compression or tension exerted on said means in a very short time span causes them to have a comparatively rigid behavior, whereas compression or tension provided over a longer time span causes the means to be comparatively slack. In fact, the means with visco-elastic properties are present in the dynamic path of a closed system formed by the stationary cutting member, the driven cutting member, the coupling element, and the housing in which the cutting unit is present. As was described above, no hairs are cut during the major portion of the cutting time. Now if means having visco-elastic properties are present between the coupling element and the driven cutting member, a small cutting gap will arise between cooperating bearing surfaces during a major portion of the cutting time, i.e. both in periods in which no hairs are cut and during cutting of hairs. The friction between the cooperating cutting edges is accordingly small. This may be explained as follows.

The cutting force occurring during cutting of a hair causes a pressure on the cutting edge of the driven cutting member, so that the driven cutting member tends to be pressed away from the stationary cutting member, which would lead to an undesirable cutting gap. The speed of the cutting process suddenly increases the pressure on the driven cutting member strongly. The damping properties of the visco-elastic material ensure that the sudden pressure rise is accommodated by the material, which behaves rigidly then. Nevertheless, a very small cutting gap arises between the cooperating cutting edges: the visco-elastic element is compressed slightly. After the hair has been cut through, the internal cutting member is pressed back towards the external cutting member under the influence of the resilient pressure of the visco-elastic element. In practice, however, another hair will often be cut through again before the cutting edges lie completely against one another. The cutting gap is so small that the cutting process is not adversely affected.

Figure 2:
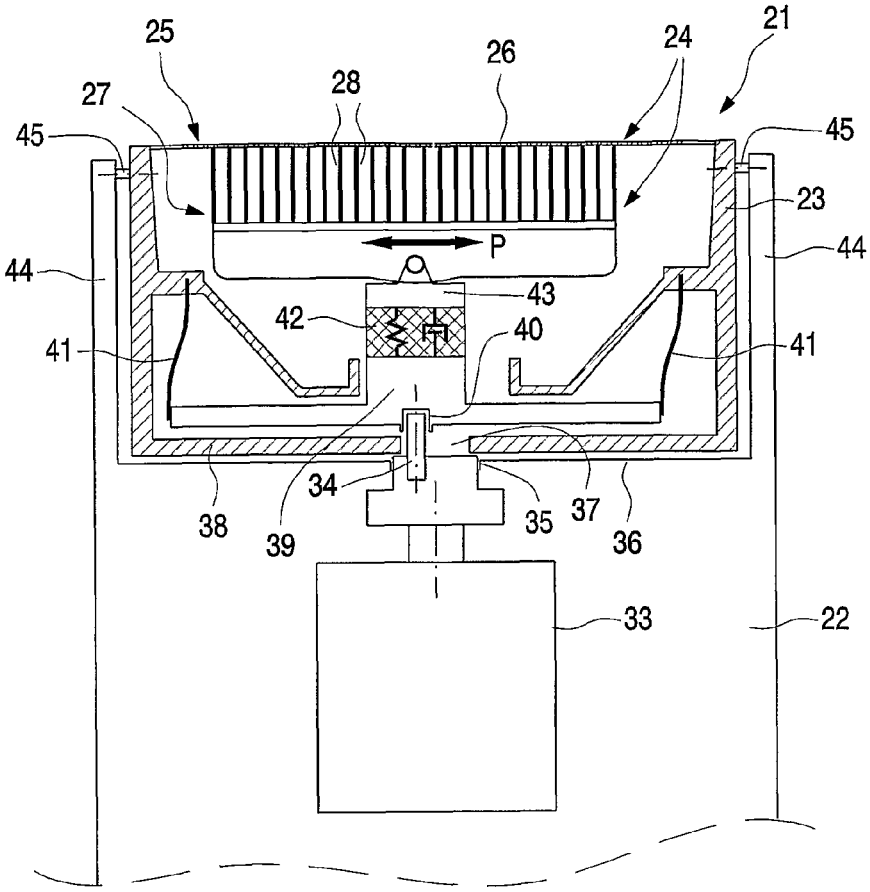
Figure 3:
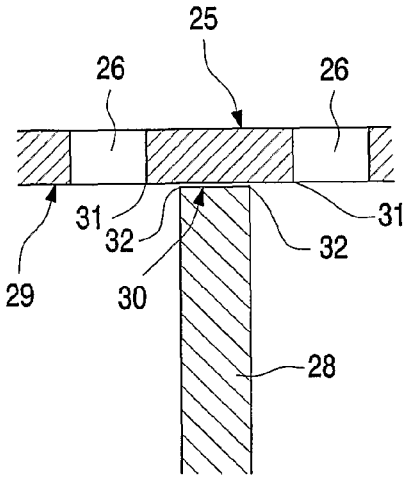

The invention will now be explained in more detail with reference to embodiments shown in the drawings, in which:

FIG. 1 diagrammatically shows a hair clipper in a first embodiment,

FIG. 2 diagrammatically shows a vibratory shaving apparatus in a second embodiment, and FIG. 3 shows a detail of the cutting unit of the shaving apparatus of FIG. 2.

The hair clipper shown in FIG. 1 has a housing 1, a cutting unit 2 comprising a stationary cutting member 3 that is fixedly fastened to the housing 1, and a driven cutting member 4. The cutting members 3, 4 are provided with respective cutting teeth 5, 6 which each have a bearing surface 7, 8, which surfaces cooperate with one another. The edges of the bearing surfaces 7, 8 have cutting edges 9, 10, respectively, which cooperate for the purpose of cutting hairs. The hair clipper is further provided with a drive mechanism comprising a rotary motor 11 which drives a drive member 12 and a coupling pin 13 into an eccentric movement. The coupling pin 13 drives a coupling element 14 so as to perform a reciprocating movement, indicated by a double arrow P. The coupling element 14 is for this purpose provided with a track 15 which extends transversely to the direction P of the reciprocating movement and in which the coupling pin 13 is arranged. The coupling element 14 is fastened by means of a visco-elastic element 16, for example glued, to the driven cutting member 4. The drive member 12 is provided with an axial bearing surface 17 that cooperates with an axial bearing surface 18 of the coupling element 14. The closed dynamic path of the cutting system is accordingly formed by the stationary cutting member 3, the driven cutting member 4, the visco-elastic element 16, the coupling element 14, and the housing 1. The visco-elastic properties of the visco-elastic element 16 are symbolized in the Figure by means of a spring and a damper symbol.

The example shown in FIG. 2 relates to a vibratory shaving apparatus with a shaving head 21 provided on a handle 22. The shaving head comprises a housing 23 in which at least one cutting unit 24 is accommodated, each such unit comprising a stationary cutting member 25 in the form of a curved foil provided with a plurality of hair trap openings 26 and a driven cutting member 27 in the form of a row of cutter blades 28 bent into the shape of the foil. The side of the foil 25 facing the driven cutting member 27 acts as a bearing surface 29 for the cutter blades 28. The ends of these cutter blades in this respect form bearing surfaces 30 for cooperating with the bearing surface 29 of the foil. The outer edges of the hair trap openings 26 form cutting edges 31 which cooperate with cutting edges 32 present at the ends of the bearing surfaces 30 of the cutter blades 28 (see detail in FIG. 3). Hairs entering the hair trap openings 26 during use of the shaving apparatus are cut by the cooperating cutting edges. The shaving apparatus has a handle 22 in which the housing 23 of the shaving head 21 comprising one or several cutting units 24 is fastened. The cutting member 27 is reciprocally driven as indicated by a double arrow P. The drive mechanism for this consists of a rotary motor 33 provided in the housing of the handle 22 with a drive member 34 in the form of a coupling pin. The drive member is driven into a rotary eccentric movement. The drive member 34 projects through an opening 35 of a housing wall 36 of the handle 22 and through an opening 37 of a housing wall 38 of the housing 23 of the shaving head 21. The drive member 34 drives a coupling element 39 into a reciprocating movement. The coupling element 39 is for this purpose provided with a track 40 which extends transversely to the direction of the arrow P (perpendicularly to the plane of drawing) and in which the drive member 34 is present. The coupling element 39 is suspended in the housing 23 of the shaving head 21 by means of blade springs 41. Since the amplitude of the reciprocating movement of the coupling element 39 is small, its vertical movement is negligible. The coupling element 39 is connected to the driven cutting member 27 by means of a visco-elastic element 42. The cutting member 27 has a connecting part 43 that is pivotably connected to the cutting member for this purpose. The visco-elastic element 42 is fastened, for example glued, to the connecting part 43. The closed dynamic path of the cutting system is accordingly formed by the stationary cutting member 25 (foil), the driven cutting member 27, the connecting part 43, the visco-elastic element 42, the coupling element 39, the blade springs 41, and the housing 23 of the shaving head 21. The visco-elastic properties of the visco-elastic element 42 are symbolized in the Figure by a spring and a damper symbol.

The shaving head 21 can be pivotably provided in the handle 22. This is indicated in FIG. 2 by means of raised wall portions 44 of the handle 22 with the pivot axes 45 between these wall portions and the housing 23 of the shaving head 21. This, however, is not essential to the invention.

The means having visco-elastic properties may comprise one element with both resilient and damping properties. As is well known in the art, visco-elasticity is measured in terms of the material's dynamic modulus (also known as complex modulus). The dynamic modulus of a material is based on the material's storage and loss moduli. Materials having such visco-elastic properties are, for example, polyborosiloxanes and bitumen. It is alternatively possible for the means having visco-elastic properties to comprise a plurality of elements, which all have both resilient and damping properties, or among which certain elements have only resilient and other elements have only damping properties. The elements must be connected in parallel in the latter case.

The invention claimed is:

1. A hair cutting apparatus with a housing and at least one cutting unit, which comprises:

a stationary cutting member and a driven cutting member that performs a reciprocating movement with respect to the stationary cutting member, wherein the driven cutting member is provided with cutting elements, each of said cutting elements of the driven cutting member and the stationary cutting member being provided with mutually cooperating bearing surfaces having cutting edges and counter-cutting edges, respectively, for cutting hairs, wherein said hair cutting apparatus further comprises a drive member for driving the driven cutting member via a coupling element, wherein a visco-elastic element is disposed between the coupling element and the driven cutting member, and wherein the visco-elastic element is comprised of polyborosiloxane.

2. The hair cutting apparatus as claimed in claim 1, wherein the apparatus is a vibratory shaving apparatus with a shaving head provided on a handle, wherein the shaving head includes the at least one cutting unit, wherein the stationary cutting member is a foil with hair trap openings, wherein the cutting elements of the driven cutting member are a row of cutter blades that cooperate with the hair trap openings, wherein a side of the foil that faces the driven cutting member is the bearing surface of the stationary cutting member, wherein edges of the hair trap openings are the cutting edges and edges of the row of cutter blades are the counter-cutting edges, and wherein the coupling element is connected to the housing by means of a blade spring suspension.

3. A hair cutting apparatus as claimed in claim 2, wherein the drive member drives the coupling element into a reciprocating movement.

4. A hair cutting apparatus as claimed in claim 2, wherein the driven cutting member is pivotably connected to a connecting part.

5. A hair cutting apparatus as claimed in claim 2, further comprising a rotary motor, the rotary motor and the drive member being housed in the handle.

6. A hair cutting apparatus as claimed in claim 2, wherein the reciprocating movement of the coupling element has a small amplitude.

7. A hair cutting apparatus with a housing and at least one cutting unit, which comprises:

a stationary cutting member and a driven cutting member that performs a reciprocating movement with respect to the stationary cutting member, wherein the driven cutting member is provided with cutting elements, each of said cutting elements of the driven cutting member and the stationary cutting member being provided with mutually cooperating bearing surfaces having cutting edges and counter-cutting edges, respectively, for cutting hairs, wherein said hair cutting apparatus further comprises a drive member for driving the driven cutting member via a coupling element, wherein a visco-elastic element is disposed between the coupling element and the driven cutting member, and wherein the visco-elastic element is comprised of bitumen.

8. The hair cutting apparatus as claimed in claim 7, wherein the apparatus is a vibratory shaving apparatus with a shaving head provided on a handle, wherein the shaving head includes the at least one cutting unit, wherein the stationary cutting member is a foil with hair trap openings, wherein the cutting elements of the driven cutting member are a row of cutter blades that cooperate with the hair trap openings, wherein a side of the foil that faces the driven cutting member is the bearing surface of the stationary cutting member, wherein edges of the hair trap openings are the cutting edges and edges of the row of cutter blades are the counter-cutting edges, and wherein the coupling element is connected to the housing by means of a blade spring suspension.

9. A hair cutting apparatus as claimed in claim 8, wherein the drive member drives the coupling element into a reciprocating movement.

10. A hair cutting apparatus as claimed in claim 8, wherein the driven cutting member is pivotably connected to a connecting part.

11. A hair cutting apparatus as claimed in claim 8, further comprising a rotary motor, the rotary motor and the drive member being housed in the handle.

12. A hair cutting apparatus as claimed in claim 8, wherein the reciprocating movement of the coupling element has a small amplitude.

* * * * *